United States Patent [19]

Dadian

[11] 4,035,939

[45] July 19, 1977

[54] LIGHTING SYSTEM FOR SELECTIVE BACK LIGHTING

[75] Inventor: Thomas F. Dadian, Santa Paula, Calif.

[73] Assignee: The United States of America as represented by the Secretary of the Air Force, Washington, D.C.

[21] Appl. No.: 647,527

[22] Filed: Jan. 8, 1976

[51] Int. Cl.[2] ..... G09F 13/04

[52] U.S. Cl. ..... 40/132 D; 40/152.2; 40/106.1

[58] Field of Search ..... 40/132 R, 130 R, 132 D, 40/106.1, 130 E; 240/2 D, 2 P, 6.4 B; 340/334

[56] References Cited

U.S. PATENT DOCUMENTS

| | | | |
|---|---|---|---|
| 1,157,856 | 10/1915 | Eubank | 40/130 E X |
| 1,751,247 | 3/1930 | Mueller | 40/130 R |
| 2,931,027 | 3/1960 | Blefary | 40/130 E X |
| 3,197,903 | 8/1965 | Walley | 40/130 R X |
| 3,499,240 | 3/1970 | Cotton et al. | 40/130 R |

FOREIGN PATENT DOCUMENTS

| | | | |
|---|---|---|---|
| 1,142,655 | 4/1957 | France | 40/130 A |

*Primary Examiner*—Louis G. Mancene
*Assistant Examiner*—Wenceslao J. Contreras
*Attorney, Agent, or Firm*—Joseph E. Rusz; Arsen Tashjian

[57] ABSTRACT

A lighting system for selectively back lighting a translucent object, or preselected portions thereof. The system, as adapted for use in back lighting an open map, includes: a flat translucent component on which the map is removably held, supported, and displayed; a core matrix, to the rear of the flat translucent component, having a plurality of identical openings therein, with each opening having an identical retaining module therein; a plurality of identical lamp subassemblies, one subassembly for each core matrix opening, which in turn comprises a lamp (configurated to fit into any one and all of the core matrix openings) in a lamp socket connected to an electrically conductive wire that is connected to an electrical connector, and a switch, interposed between the lamp socket and the electrical connector, that is connected to the wire; a terminal board having an electrical input, and a plurality of electrical outputs any one of which is connectable to any of the connectors of the lamp subassemblies; and, a source of electrical power having an output to which is connected a wire lead at one end and the terminal board input at the other end, with a switch connected to the wire lead between the power source output and the terminal board input. Unlike the prior art, this system, among other distinct and significant advantages, permits the selective back lighting of near points on the map (or of the entire map), is portable and easily movable, and the lamps and respective lamp sockets are releasably lockable with the core matrix to prevent accidental removal by shock, vibration, or pulling.

6 Claims, 2 Drawing Figures

FRONT
REAR
SWITCH
SWITCH
10
20
21
22
30
31
32
33
38
38A
40
42
42E
42G
42H
46
46A
46B
46C
46D
46E
46F
46G
46H
47
47A
47B
51
51A
51B
52
56
56A
56B
65
67
68
68A
68B
70
74

LIGHTING SYSTEM FOR SELECTIVE BACK LIGHTING

STATEMENT OF GOVERNMENT INTEREST

The invention described herein may be manufactured and used by or for the Government for governmental purposes without the payment of any royalty thereon.

BACKGROUND OF THE INVENTION

This invention relates to a unique lighting system for selectively back lighting a translucent object, or preselected portions thereof, and more particularly to an adaptation for use in selectively back lighting a displayed translucent map.

Back lighting systems, as such, are old and well known in the art. However, it is fair and accurate to say that there is no known method or apparatus for selectively back lighting preselected portions or "points" of a translucent object, such as a displayed map, wherein the preselected portions thereof are "near", such as within 0.25 inch ($\pm 0.1$).

I have invented such a selective back lighting system; and, thereby, I have significantly advanced the state-of-the-art.

SUMMARY OF THE INVENTION

This invention pertains to the back light art, and is a lighting system for selectively back lighting preselected portions of a translucent object, even if said portions are "near," as defined hereinabove.

Therefore, the principal object of this invention is to teach the structure of such a selective back lighting system.

Another object of this invention is to teach an adaption of the above-described back lighting system, wherein the system is for use in selectively back lighting preselected "points" or portions of a displayed translucent map.

Other objects of this invention include, but are not limited to, providing such a back lighting system: that is portable; that is easily removable, so it can be easily relocated; that is releasably lockable in place to prevent accidental removal by shock, vibration, or pulling; and that is useable with a terminal board having outputs of the male wire wrap post type.

These objects, and other equally important and related objects, of this invention will become readily apparent after a consideration of the description of the invention and reference to the Figures of the drawing.

It is here to be noted that in each Figure directional arrows, together with the legended designations "Front" and "Rear", are shown to assist the reader. The direction designation "Rear" is intended to be synonymous with "Back" and the like.

DESCRIPTION OF THE PREFERRED EMBODIMENT

Figure 1:
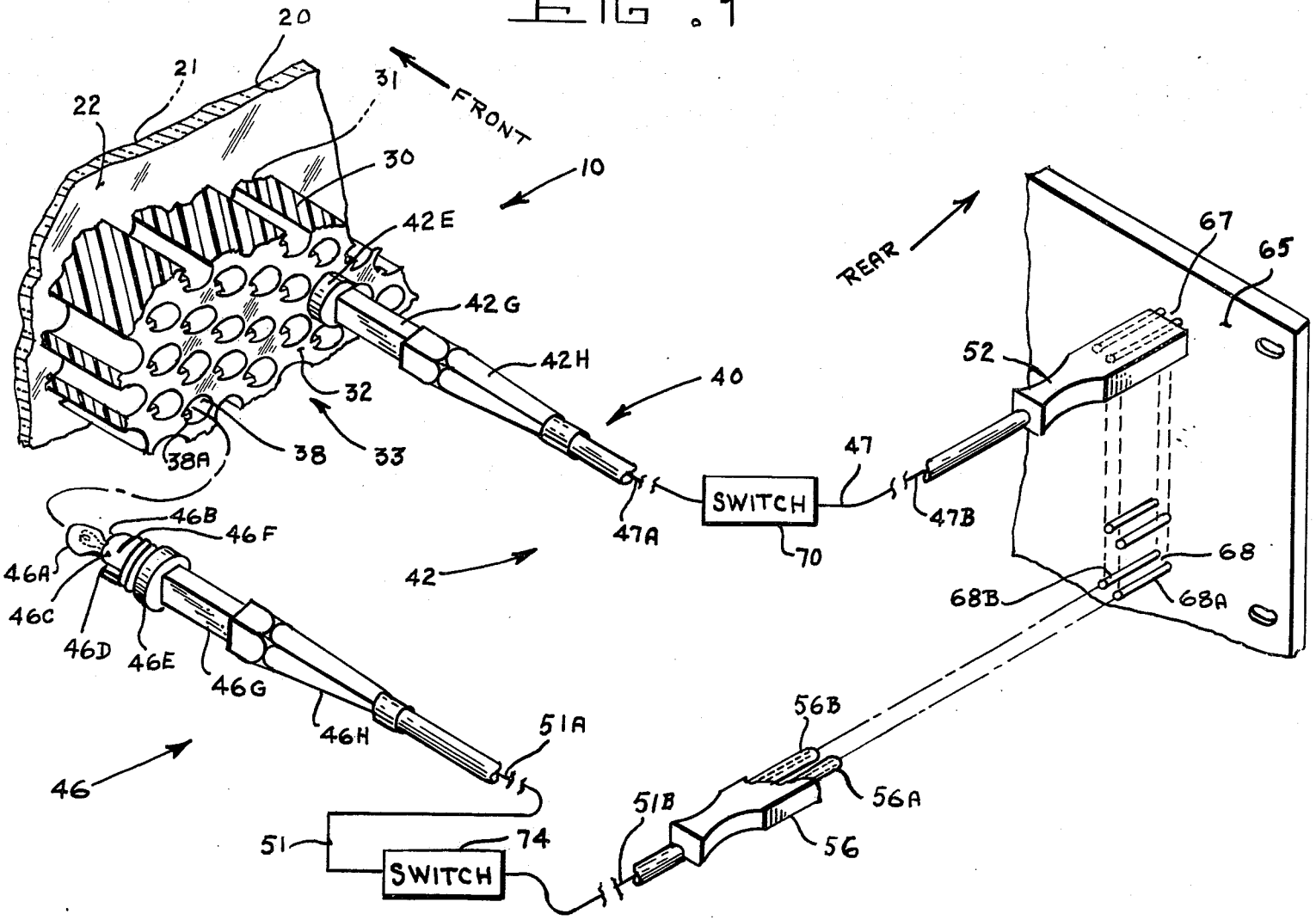
FIG. 1 is a side elevation view in simplified form, partially schematic, partially fragmented, partially exploded, and partially in perspective, of a preferred embodiment of the inventive back lighting system, as adapted for a particular use, namely: to back light selectively preselected points or portions of a displayed translucent map; and, FIG. 2 is a top plan view, in simplified schematic form, of the preferred embodiment, showing the major components thereof, and their respective positional relationships.
Figure 2:
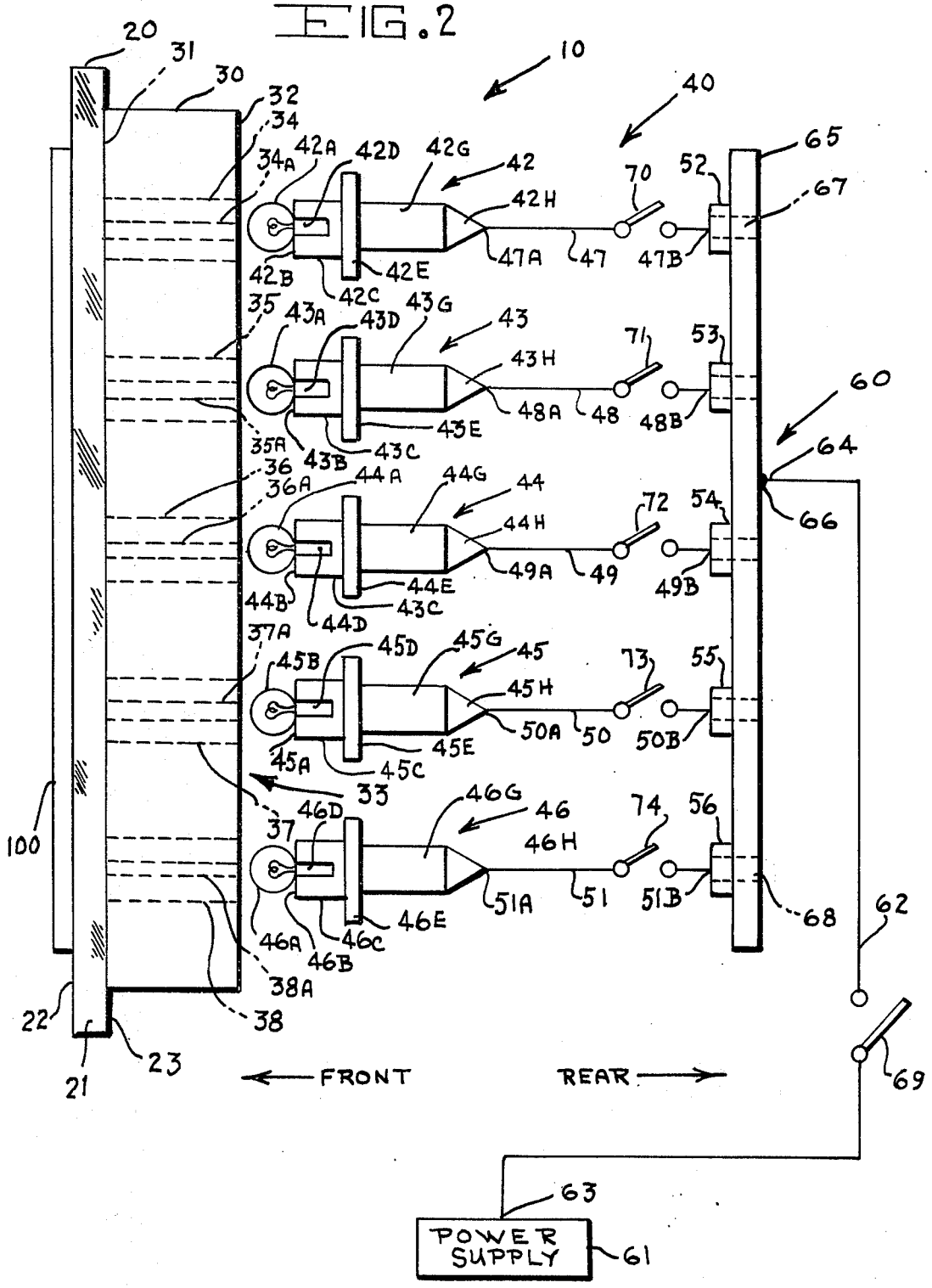

With reference to FIGS. 1 and 2 of the drawings, the preferred embodiment 10 includes, in cooperative association: means 20 for removably holding, supporting, and displaying the translucent object 100, such as an opened map; a core matrix 30 to the rear of said holding, supporting and displaying means 20; and, a lighting assembly 40, disposed essentially rearward of the core matrix 30.

The holding, supporting, and displaying means 20 includes a flat translucent component 21 having a front surface 22 and a rear surface 23.

The core matrix 30 also has a front and a rear surface, 32, with the front surface 31 abutting with the rear surface 22 of the flat translucent component 20. The core matrix 30 includes a plurality 33 of identically configurated openings, such as representative ones 34, 35, 36, 37 and 38, in and through the core matrix 30. In turn, each identical opening, such as 38, has a retaining nodule, such as 38A, therein, with each nodule, such as representative ones 34A, 35A, 36A, and 38A, being identical and also being identically situated within its respective opening.

The lighting assembly 40 includes: a plurality 41 of identical lamp subassemblies, such as representative ones 42, 43, 44, 45 and 46, with each one of the identical lamp subassemblies having a corresponding identical lamp, such as 42A, 43A, 44A, 45A and 46A, and with each identical lamp, such as representative one 42A, dimensioned and shaped to fit into any one (i.e., all) of the identically configurated core matrix openings, such as representative ones 34–38, inclusive; and, means 60 for selectively energizing any one or more, including all, of the identical lamps.

Each of the plurality 41 of identical lamp subassemblies, such as representative one 46, also includes: a lamp socket, such as 46B, in connection with its respective lamp 46A; an electrically conductive wire component, such as 51, having a first end, such as 51A, and a second end, such as 51B, with the first end 51A in electrical connection with its respective lamp socket 46B; and, an electrical connector, such as representative one 56, attached to, and in electrical connection with, the second end 51B of its respective wire component 51. For illustration purposes, the other of the plurality of representative lamp sockets have been designated 42B, 43B, 44B and 45B; the other of the plurality of representative wire components are shown as 47, 48, 49 and 50; and, the respective first and second ends of each of the other said wire components are 47A and 47B, 48A and 48B, 49A and 49B, and 50A and 50B; and the respective other electrical connectors are referenced 52, 53, 54 and 55.

Each of the identical lamp sockets, such as representative one 46B, has an electrically non-conductive external surface, such as 46C, with a forward portion, a rear portion, and a rear end portion, with a groove, such as 46D, in the forward portion, wherein the groove 46D is shaped and dimensioned to fit on, and mate with, any and all identical retaining nodules, such as representative ones 38A and 34A, of core matrix 30. For illustrative purposes, the external electrically non-conductive surfaces of the other lamp sockets are shown as 42C, 43C, 44C and 45C; and, their respective grooves are designated 42D, 43D, 44D and 45D.

Additionally, each of the identical lamp sockets, such as representative one 46B, has a base, such as 46E, made of electrically non-conductive material, with the base having a front surface and a back surface, and with the front surface attached to, and extending outwardly from, the rear end portion of the external surface 46C of the lamp socket, and with its respective electrically conductive wire component 51 passing through the lamp socket base 46E.

Further, each of the identical lamp sockets, such as representative one 46B, has a retaining spring, such as 46F, encircling the rear portion of the external surface 46C of the lamp socket 46B, and abutting with the lamp socket base 46E. In the interest of maintaining simplicity of the FIG. 2, the retaining springs are not shown therein; and, the retaining spring of lamp subassembly 42 is not shown in FIG. 1, because the lamp socket 42B, and of course the spring, are in the inserted position.

Each lamp subassembly, such as representative one 46, preferably has (but need not have) a holder 46G, with which to hold the particular lamp subassembly, such as 46. The holder, such as 46G, has a first end and a second end, with the first end attached to the back surface of the lamp socket base 46E, and with the respective electrically conductive wire component, such as 51, passing through its respective lamp assembly holder 46G. The other of the lamp subassembly holders are referenced 42G, 43G, 44G, and 45G.

Additionally, each lamp subassembly, such as representative one 46, preferably has (but need not have) a strain relief component 46H, made of electrically non-conductive material, and attached to the second end of the respective lamp subassembly holder 46G, and with the respective electrically conductive wire component, such as 51, passing through its respective strain relief component 46H. The other of the strain relief components are designated as 42H, 43H, 44H and 45H.

The previously mentioned means 60 for selectively energizing any one, or more, of all lamp(s) of the plurality of identical lamps, such as 42A–46A, inclusive, includes: a source of electrical power 61; an electrically conductive lead component 62 having a first end 63 and a second end 64, with the first end 63 in electrical connection with the power source 61; a terminal board 65 having an electrical input 66, and a plurality of electrical outputs, such as representative ones 67 and 68, in electrical parallel connection with each other, with the input 66 in electrical connection with the second end 64 of the electric lead 62; a first switch 69 in electrical connection with the electric lead 62, and interposed between the first and the second ends, 63 and 64, of the lead 62; and, a plurality of second switches, such as representative ones 70 and 74, with one switch for each electrically conductive wire component, such as 47 and 51, and with each second switch, such as 70 and 74, in electrical connection with, and interposed between, the first and second ends of its respective electrically conductive wire component, e.g., second switch 74 is connected to wire 51 between ends 51A and 51B.

Each electrical connector, such as representative ones 52 and 57, of each lamp subassembly, such as 42 and 46, preferably is (but need not be) of the female contact pin type, e.g., connector 56 has female configurated (hollow) contact pins 56A and 56B; and, therefore, each electrical output, such as representative ones 67 and 68, preferably is (but need not be in another case) of the male wire wrap post type, e.g., wire wrap posts 68A and 68B, which are complementary to female hollow pins 56A and 56B, are male-configurated.

MANNER OF OPERATION OF THE PREFERRED EMBODIMENT

The manner of operation of the preferred embodiment 10 of my invention lighting system can easily be ascertained by a person or ordinary skill in the lighting art from the foregoing description, coupled with reference to FIGS. 1 and 2 of the drawings.

For others, it is sufficient to say in explanation that, after the translucent object (such as a map 100) is held, supported, and displayed by and with the use of means 20, the desired or needed identical lamp subassemblies or subassembly, such as 46, is hooked up by plugging its connector 56 into the complementary male wire wrap pins 68A and 68B; and, with the use of the lamp subassembly holder 46G, the lamp 46A and the lamp socket 46C are then plugged into the desired core matrix opening, such as 38, by allowing the respective retaining nodule 38A to ride up the lamp socket groove 46D and, thereby, releasably lock the lamp socket 46C (and, thereby, the lamp 46A) in place, because of the bayonet-type interconnection between the lamp socket groove 46D and the core matrix opening nodule 38A. In this position, the spring 46F is applying an outward force to the lamp socket base 46E, which said force holds and/or assists in holding the lamp socket 46C in the locked position. Then, the appropriate second switch, such as 74, is closed; and, thereafter, the first switch 69 is closed.

To disconnect and remove the lamp subassemblies or subassembly, such as 46, the above-described procedure is reversed, i.e., the second switch 74 is opened; the first switch 69 is opened; the connector 56 is disconnected, and separated from, contact pins 68A and 68B; and, the lamp socket 46C and the lamp 46A are removed and are disconnected from core matrix 30 by grasping lamp subassembly holder 46G, pushing inward, and turning it, thereby disengaging and relasing the lamp socket groove 46D from the retaining nodule 38A.

CONCLUSION

It is abundantly clear from all of the foregoing, and from the Figures of the drawings, that the stated and desired objects of my invention have been attained. In addition, other related objects have been achieved. For example, a light spot of consistent intensity is provided, because the lamp, such as 46A, is always the same distance from the flat translucent component 21.

It is to be noted that, although there have been described the fundamental and unique features of my invention as applied to a particular preferred embodiment 10, various other embodiments, adaptations, additions, omissions, and the like will occur to, and can be made by, those or ordinary skill in the art, without departing from the spirit of our invention.

What is claimed is:

1. A lighting system for selectively back lighting preselected portions of a translucent object, comprising:

a. means for removably holding, supporting, and displaying said translucent object, wherein said means includes a flat translucent component having a front surface, on which said translucent object is removably held, supported and displayed, and a rear surface;

b. a core matrix having a front surface abutting said rear surface of said flat translucent component, and also having a rear surface, wherein said core matrix includes a plurality of identically configurated openings therethrough, with each said opening having a nodule therein, with each nodule being identical and also being identically situated within each opening;

c. and, a lighting assembly disposed essentially rearward of said rear surface of said core matrix, and in operative association with said core matrix, wherein said lighting assembly includes:

1. a plurality of identical lamp subassemblies, one for each said core matrix opening, with each one of said plurality of identical lamp subassemblies having an identical lamp, with each said lamp dimensioned and shaped to fit into any one of said plurality of identically configurated openings in said core matrix;

2. and, means for selectively energizing any lamp of said plurality of identical lamps of said plurality of identical lamp subassemblies.

2. A lighting system, as set forth in claim 1, wherein each one of said plurality of identical lamp subassemblies also includes:

a. a lamp socket in electrical connection with said lamp of said lamp subassembly, wherein lamp socket has an electrically non-conductive external surface with a forward portion, a rear portion, and a rear end portion, with a groove in said forward portion, wherein said groove is shaped and dimensioned to fit on, and mate with, any said nodule of said core matrix;

b. an electrically conductive wire component having a first end and a second end, with said first end in electrical connection with said lamp socket;

c. and, an electrical connector attached to, and in electrical connection with, said second end of said electrically conductive wire component.

3. A lighting system, as set forth in claim 12, wherein each of said plurality of identical lamp subassemblies further includes:

a. a lamp socket base made of electrically non-conductive material, with said lamp socket base having a front surface and a back surface, and with said front surface attached to, and extending outwardly from, said rear end portion of said external surface of said lamp socket, and with said electrically conductive wire component passing through said lamp socket base;

b. and, a retaining spring encircling said rear portion of said external surface of said lamp socket, and abutting with said lamp socket base.

4. A lighting system, as set forth in claim 3, wherein each of said plurality of identical lamp subassemblies also further includes:

a. a lamp subassembly holder made of electrically non-conductive material and having a first end and a second end, with said first end attached to said back surface of said lamp socket base, and with said electrically conductive wire component passing through said lamp subassembly holder;

b. and, a strain relief component, made of electrically non-conductive material, attached to said second end of said lamp subassembly holder, and with said electrically conductive wire component passing through said strain relief component.

5. A lighting system, as set forth in claim 2, wherein said means for selectively energizing any lamp of said plurality of identical lamps of said plurality of identical lamp subassemblies includes:

a. a source of electrical power;

b. an electrically conductive lead component having a first end and a second end, with said first end in electrical connection with said power source;

c. a terminal board having an electrical input, and a plurality of electrical outputs in electrical parallel connection with each other, with said input in electrical connection with said second end of said electrically conductive lead component;

d. a first switch in electrical connection with said electrically conductive lead component and interposed between said first and second ends of said electrically conductive lead component;

e. and, a plurality of second switches, with one said second switch for each said electrically conductive wire component of each identical lamp subassembly, and with each said second switch in electrical connection with, and interposed between, said first and seond ends of its respective said electrically conductive wire component.

6. A lighting system, as set forth in claim 5, wherein said electrical connector of said lamp subassembly is of the female contact pin type, and wherein each said electrical output of said terminal board is of the male wire wrap post type.

* * * * *